US006470973B1

(12) United States Patent
Rangnes et al.

(10) Patent No.: US 6,470,973 B1
(45) Date of Patent: Oct. 29, 2002

(54) SIDE ELEMENT OF A DRILLING TEMPLATE

(75) Inventors: Atle Rangnes, Asker (NO); Jon Thoresen, Kongsberg (NO); Morten Backe, Drammen (NO); Tore Knoph, Bindalseiedet (NO)

(73) Assignee: Kongsberg Offshore A/S, Kongsberg (NO)

( * ) Notice: Subject to any disclaimer, the term of this patent is extended or adjusted under 35 U.S.C. 154(b) by 0 days.

(21) Appl. No.: 09/530,649

(22) PCT Filed: Oct. 30, 1998

(86) PCT No.: PCT/NO98/00323

§ 371 (c)(1),
(2), (4) Date: Aug. 22, 2000

(87) PCT Pub. No.: WO99/23353

PCT Pub. Date: May 14, 1999

(30) Foreign Application Priority Data

Nov. 3, 1997 (NO) ..... 975065

(51) Int. Cl.[7] ..... E21B 7/128
(52) U.S. Cl. ..... 175/7; 166/341; 166/360
(58) Field of Search ..... 175/7; 166/351, 166/338, 339, 341, 360, 357

(56) References Cited

U.S. PATENT DOCUMENTS 3,032,125 A * 5/1962 Hiser et al. ..... 166/339
3,177,954 A * 4/1965 Rand ..... 166/358
4,095,649 A * 6/1978 Chateau et al. ..... 166/339
4,126,008 A * 11/1978 Dixon ..... 175/7 X
4,452,312 A * 6/1984 Roblin ..... 166/339
5,002,129 A 3/1991 Hopper
5,040,607 A 8/1991 Cordeiro et al.
5,246,075 A * 9/1993 Caulfield ..... 166/339
5,441,112 A 8/1995 de Melo Sanches et al.
5,526,882 A * 6/1996 Parks et al. ..... 166/339

FOREIGN PATENT DOCUMENTS

| | | |
|---|---|---|
| GB | 2202257 A | 9/1988 |
| GB | 2226063 A | 6/1990 |
| GB | 2285274 A | 7/1995 |
| NO | 159193 | 8/1988 |
| NO | 179844 | 9/1996 |
| NO | 179981 | 10/1996 |
| WO | 9606260 A1 | 2/1996 |

* cited by examiner

*Primary Examiner*—David Bagnell
*Assistant Examiner*—John Kreck
(74) *Attorney, Agent, or Firm*—Young & Thompson

(57) ABSTRACT

An improvement in a side element of a drilling template for wells at sea for extracting hydrocarbons, wherein the side element is connected to a central section of the drilling template and projects horizontally out therefrom. The side element is arranged to carry equipment of various types. According to the invention the side element comprises a coupling section for releasable connection with a coupling section of the equipment.

12 Claims, 5 Drawing Sheets

SIDE ELEMENT OF A DRILLING TEMPLATE

BACKGROUND OF THE INVENTION

The invention relates to an improvement in a side element of a drilling template for wells at sea.

DESCRIPTION OF THE RELATED ART

From e.g., GB 2 285 274 (corresponding to Norwegian patent application no. 944545) it is known that a drilling template can be lowered from a platform at sea to a mooring device on the seabed by means of guidelines, which extend from the platform to the mooring device. To the sides of a central section of the drilling template there are hinged via hinge pins which are attached to the central section a number of side or wing elements which can be tilted from a first position, wherein they extend vertically upwards from the hinge axis to a second position or operating position, wherein they extend horizontally outwards from the central section. In the first or upwardly tilted position the drilling template's diameter measured in a horizontal plane is minimal, thus enabling the drilling template to be lowered through a moon pool of the platform. When the drilling template has been installed on the seabed, the side elements can be tilted down to the operating position. Each side element carries equipment for a specific purpose. If equipment is required for another purpose when using a side element, the side element can be removed by unhooking it from its hinge pin. The side element can then be raised to the platform, by guiding it by the guidelines, whereupon another side element can be lowered to the drilling template and hooked on to the hinge pin.

When using a drilling template which is arranged to be lowered to the mooring device without the use of guidelines, as described in applications submitted simultaneously with this application, however, it may be difficult to hook on the side element since there is little room between other pieces of equipment on the drilling template and the hooks which have to be attached to the hinge pin are small.

SUMMARY OF THE INVENTION

The object of the invention, therefore, is to provide a device of the above-mentioned type which is not encumbered with the above-mentioned disadvantages.

The invention will now be described in more detail with reference to the drawing which schematically illustrates embodiments of the device according to the invention.

DESCRIPTION OF THE PREFERRED EMBODIMENTS

Figure 1:
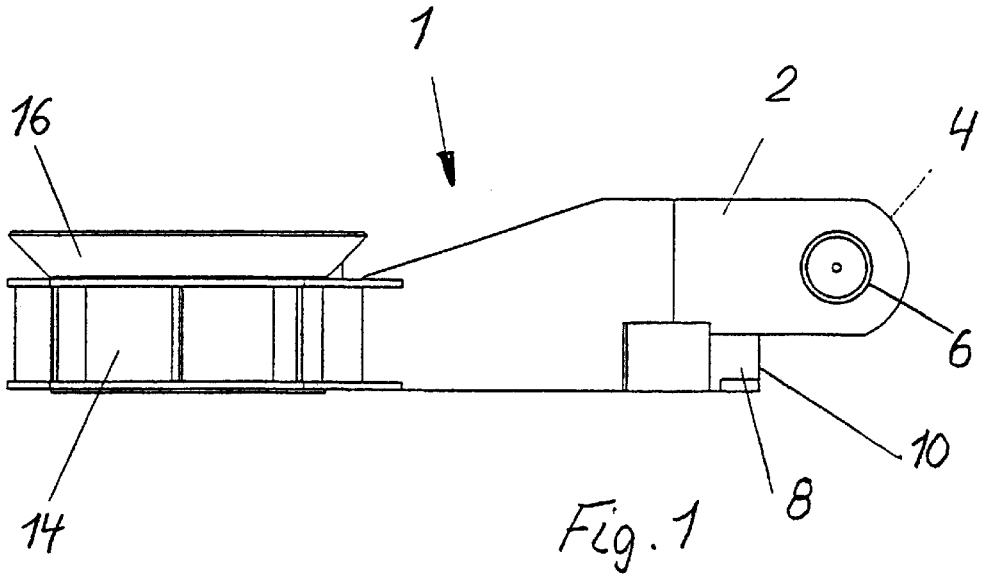
FIG. 1 is a side view of a first embodiment of a side element of a drilling template.

With reference to the drawing, the direction indication "up" should be understood as the direction towards the edge of the drawing facing away from the reader.

The side element 1 which is illustrated in FIG. 1 is located in the second, downwardly tilted position and comprises a hinge section 2 which is provided at one end of the side element, and which may comprise flanges 4 with mutually coaxial, through-going holes through which there extends a hinge pin 6. The side element 1 is linked to the central section of a drilling template (not shown), the central section having a supporting section which is connected with the flanges 4 via the hinge pin 6, which also extends through holes in this supporting section.

At a distance from the hinge pin 6 the hinge section has a contact section 8 with a contact surface 10 which is arranged for abutment against a corresponding contact section (not shown) of the drilling template's central section, with the result that forces which are exerted against the hinge pin 6 and the contact section 8 create a reactive power moment which counteracts the static moment about the hinge pin axis as a result of the weight of the side element and any equipment carried thereon.

At the other end of the side element there is provided a receiving section 14 which comprises, e.g., a truncated cone-shaped funnel or female section 16, which is diverging upwards when the side element is located in the position which is illustrated in FIG. 1. A section through this receiving section 14 is indicated by broken lines in FIG. 3. From the narrow, lower end of the funnel 16 there extends downwardly a tubular section or pipe 18 or longitudinal fingers which are arranged along a circle, at the bottom of which are radially inwardly projecting flanges or claws 22. These claws can be moved radially inwards towards the funnel's longitudinal axis by means of a spring device or outwards by means of suitable actuators (not shown) of any known type which can be operated by, e.g., a remotely operated subsea vessel or vehicle, hereinafter called a ROV (not shown), and which are mounted on the side element. Alternatively, they may also be moved radially inwards by means of such a vehicle.

In the pipe 18 there may be provided engagement elements in the form of ribs, lug or notches 26 which can be brought into engagement with below described complementarily provided notches, ribs or lugs of pin sections of adapters which are arranged to be connected with the side element, thus enabling the adapter to be secured in a fixed angular position about the funnel section's longitudinal axis, relative to the side element.

Figure 2:
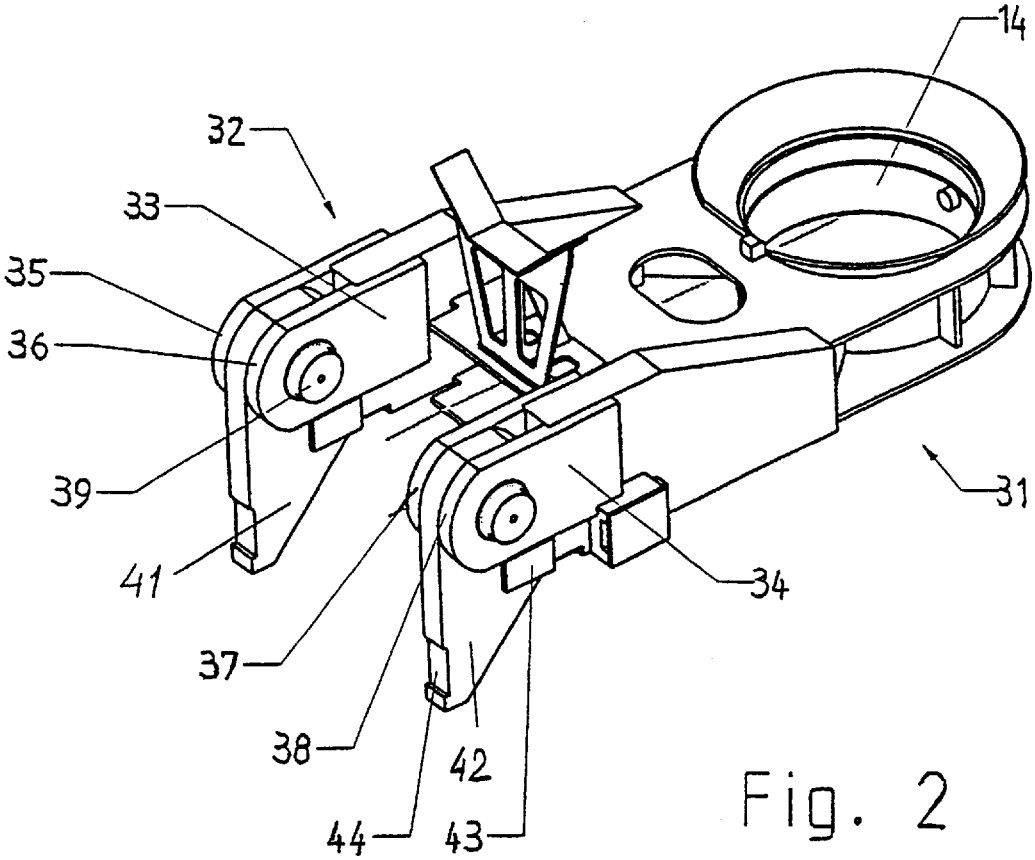
FIG. 2 is a perspective view of a second embodiment of a side element.

FIG. 2 illustrates a second embodiment of a side element 31 according to the invention. This has a hinge section 32 with two flange pairs 33, 34 comprising flanges 35,36 and 37, 38 respectively which are arranged spaced apart from each other. Between the flange pairs there may be placed an outwardly projecting section of the drilling template's central section, and through the flanges and this intermediate section there are provided mutually coaxial holes through which there extends a hinge pin 39, thus enabling the side element 31 to be tilted in the above-mentioned manner.

In order to prevent the side element 31 from rotating further when it is pivoted from the upwardly pivoted to the downwardly pivoted position, between the flanges 35,36,37, 38 of each flange pair 33,34 there is inserted a substantially disc-shaped accompanying element 41 and 42 respectively which similarly have a through-going hole through which the hinge pin 39 also extends, thus enabling the accompanying elements to rotate relative to the side element. Each accompanying element 41, 42 has a shoulder section 43 and a contact surface 44.

It should be understood that the contact surfaces 44 or the accompanying elements 41, 42 in the illustrated position abut against contact surfaces (not shown) of the drilling template's central section.

The side element 31 can thereby be freely tilted up, i.e. pivoted anticlockwise about the hinge pin 39 from the position which is illustrated in FIG. 2 an angular distance of at least 90° without bringing along the accompanying elements 41, 42. However, when the side element is pivoted the other way and down from its upwardly tilted position and when it reaches the downwardly tilted position, lateral surfaces of the flanges 33,34,35,36 come into abutment against the shoulders 43, and because the accompanying elements' contact surfaces 44 abut against the contact surfaces of the drilling template's central section, the side elements will be stopped in the downwardly tilted position.

The distance between the axis of the hinge pin 39 and the contact surfaces 44 of the side element 31 is greater than the distance between the hinge pin 6 and the contact surface 10 of the side element 1. The forces which constitute a reactive moment which counteracts the above-mentioned static moment of the side element and the equipment carried thereon thereby become less in the case of the side element 31 than for the side element 1.

The accompanying element could have been securely connected to the drilling template's central section, but the weight of the latter would then have been increased, which is disadvantageous, since the cranes which are employed for moving equipment from supply ships on board the platform have a limited lifting capacity. The drilling template's components can therefore be lifted on board the platform in smaller groups and mounted on the platform. In addition welding and screwing operations as well as possibly an X-ray control of welds are avoided, thus providing a reduction in the production costs for the drilling template.

The accompanying elements could further have been securely connected to the side element, but the elements would then have projected outwards from the drilling template's central section when the side element is located in its upwardly tilted position, which would have caused the drilling template to have a large transverse dimension, ruling out the possibility of lowering the drilling template through the moon pool.

Figure 3:
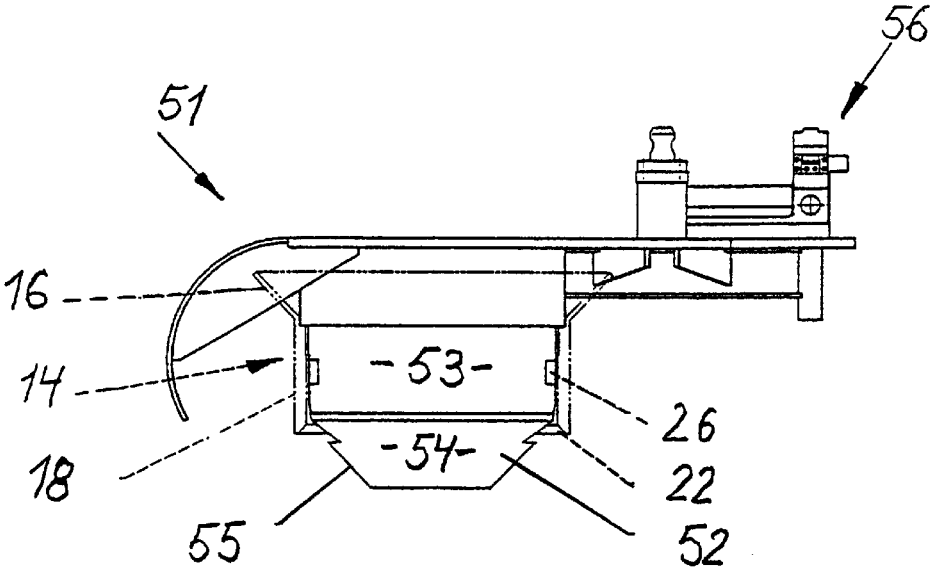
FIGS. 3–9 are side views on different scales of adapters for various applications of the side element.

FIG. 3 is a view of an adapter 51 for retracting pipes into the drilling template. The adapter comprises a downwardly facing pin section 52. At the top the pin 52 has a cylindrical section or cylinder 53 whose diameter is slightly smaller than the inner diameter of the pipe 18 of the side element's receiving section 14. At the bottom the pin has a male cone section 54, whose largest diameter is slightly smaller than the smallest diameter of the side element's pipe 18. The male cone section 54 can come into engagement with the claws 22 of a side element 1, 31, in order thereby to secure the pin section 52 in engagement with the receiving section 14.

In order to connect the adapter and a side element 1, 31, the adapter's pin section 52 is first lowered and passed downwards into the receiving section 14, whereby the respective conical sections cause a relative alignment and these sections extend coaxially. The pin section 52 is then lowered further, with the result that its barbed section 55 comes into engagement with the claws 22 and the pin section 52 is secured in the receiving section 14.

This engagement can be released by the operation of the claw actuators for coupling the adapter 51 from the side element, e.g. if it is required to insert another adapter in this side element, the actuators, e.g. moving the claws radially outwards.

The adapter 51 may have a landing place or device 56 for, e.g., a tool for retracting a pipe.

Figure 4:
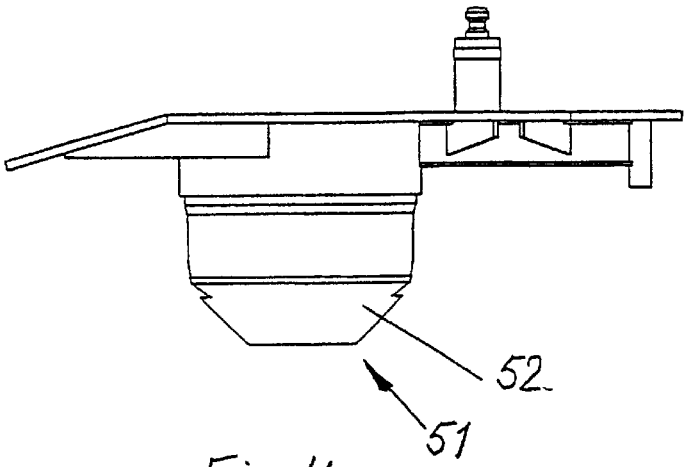

FIG. 4 illustrates this adapter on a reduced scale, some components thereof having been removed.

Figure 5:
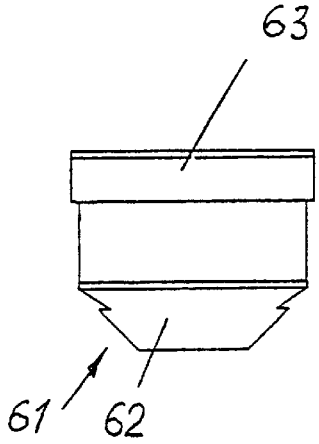

FIG. 5 is a view of an adapter 61 with a pin section 62 which can be brought into engagement with the receiving section 14 of a side element, and an upper, upwardly extended truncated cone-shaped female section or funnel 63 for receiving, e.g., a pin section of a second adapter (not shown). Use of such an adapter 61 may be relevant, e.g., if the side element's receiving section 14 is not adapted to the pin section of the second adapter.

Figure 6:
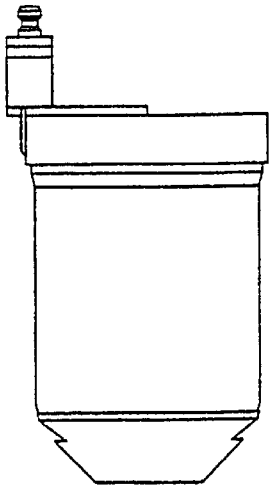
Figure 7:
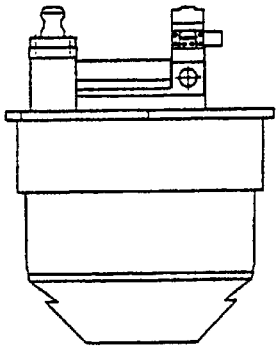

FIGS. 6 and 7 are views of other retraction adapters.

Figure 8:
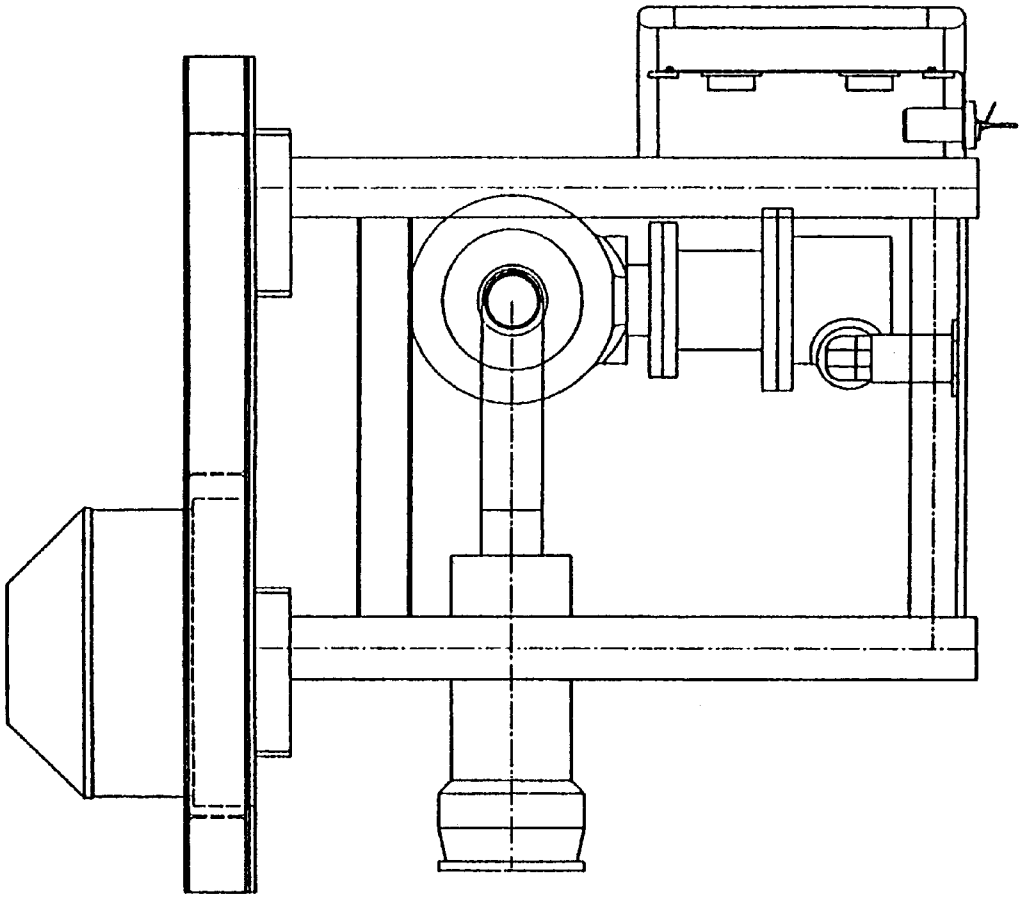

FIG. 8 is a view of an adapter with a U-shaped pipe, e.g. for receiving a plug from a pipe and inserting the plug in a second pipe.

Figure 9:
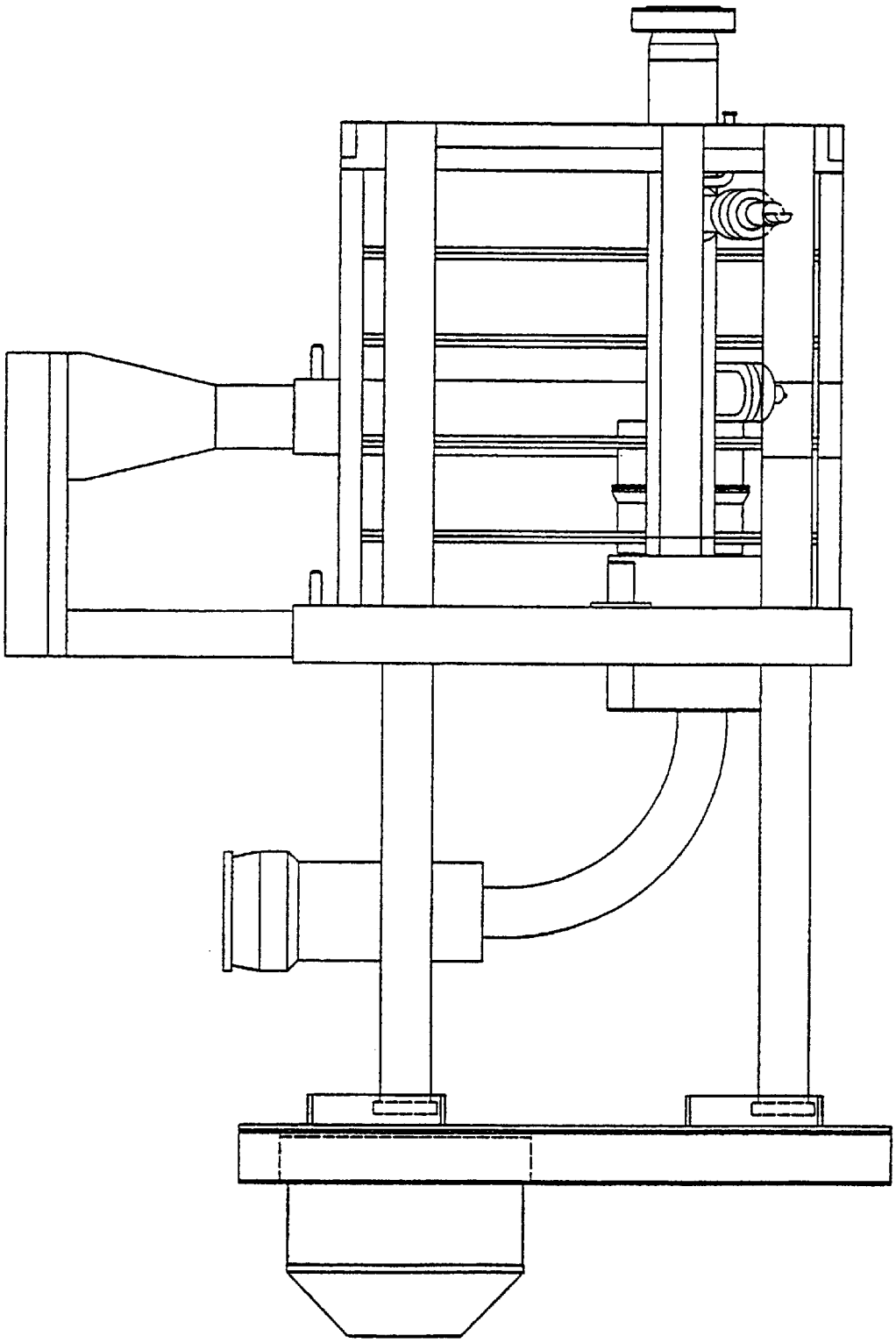

FIG. 9 is a view of an adapter for inserting a plug.

In the adapters according to FIGS. 8 and 9 the male cone sections are short in comparison with the cylinder sections.

Even though the device according to the invention is specially suited for use with drilling templates where no guidelines extend therefrom to a platform at the surface of the sea, it will be understood that it may be employed with drilling templates which are connected to the platform via guidelines. Moreover, it will be understood that the side elements may be securely connected to the drilling template in the folded position wherein they extend horizontally.

What is claimed is:

1. A side element of a drilling template, comprising:

a first end and a second end;

a hinge section (2) at the first end, the hinge section comprising flanges (4) with mutually coaxial, through-going holes;

a hinge pin (6) extending through the through-going holes, the flanges and through-going holes adapted to link the hinge section to a central section of a drilling template via the hinge pin;

the hinge section having a contact section (8) with a contact surface (10) for abutment against a corresponding contact section of the drilling template;

a receiving section (14) at the second end, the receiving section comprising a truncated cone-shaped funnel section (16) diverging upwards when the receiving section is in a normal horizontal, upright position;

an adapter, with first and second connection sections, the first connection section for releasable connection with the receiving section and the second connection section for releasable connection with drilling equipment; and at a narrow, lower end of the funnel section, a tubular section (18) with inwardly projecting claws (22), the claws being movable radially inwards towards a longitudinal axis of the funnel section to releasably engage the adapter, wherein the hinge section further includes a disc-shaped accompanying element secured by the hinge pin and positioned to prevent the receiving section from pivoting below a horizontal line described by the normal horizontal, upright position.

2. The side element of claim 1, wherein the inwardly projecting claws include inwardly facing engagement elements for engaging into the adapter.

3. The side element of claim 2, wherein the engagement elements are ribs which engage in complementary notches of the adapter.

4. The side element of claim 1, wherein the first connection section of the adapter comprises a lower barb-shaped section and the claws engage the barbed section.

5. The side element of claim 4, wherein, the side element is operable by a remotely operated vessel.

6. The side element of claim 1, wherein the second connection section comprises a landing for releasable connection with a pipe retracting tool.

7. The side element of claim 1, wherein the adapter further comprises a U-shaped pipe for receiving a plug from a first pipe and inserting the plug into a second pipe.

8. A side element of a drilling template, comprising:

a first end and a second end;

a hinge section (2) at the first end, the hinge section comprising flanges (4) with mutually coaxial, through-going holes;

a hinge pin (6) extending through the through-going holes, the flanges and through-going holes adapted to link the hinge section to a central section of a drilling template via the hinge pin;

the hinge section having a contact section (8) with a contact surface (10) for abutment against a corresponding contact section of the drilling template;

a receiving section (14) at the second end, the receiving section comprising a truncated cone-shaped funnel section (16) diverging upwards when the receiving section is in a normal horizontal, upright position;

an adapter, with first and second connection sections, the first connection section for releasable connection with the receiving section and the second connection section for releasable connection with drilling equipment; and at a narrow, lower end of the funnel section, a tubular section (18) with inwardly projecting claws (22), the claws being movable radially inwards towards a longitudinal axis of the funnel section to releasably engage the adapter, wherein, the adapter first connection section includes a downwardly facing pin section (52), a cylindrical section (53) at a top of the pin section, and a male cone section (54) at a bottom of the pin section, the male cone section having an circular indentation engageable with the claws to secure the pin section to the receiving section.

9. The side element of claim 8, wherein the inwardly projecting claws include inwardly facing engagement elements for engaging into the adapter.

10. The side element of claim 8, wherein the engagement elements are ribs which engage in complementary notches of the adapter.

11. The side element of claim 8, wherein the second connection section comprises a landing for releasable connection with a pipe retracting tool.

12. The side element of claim 8, wherein the adapter further comprises a U-shaped pipe for receiving a plug from a first pipe and inserting the plug into a second pipe.

* * * * *